US011452310B2

(12) United States Patent
Qiu

(10) Patent No.: US 11,452,310 B2
(45) Date of Patent: Sep. 27, 2022

(54) ATOMIZER AND ELECTRONIC CIGARETTE HAVING THE SAME

(71) Applicant: Changzhou Patent Electronic Technology Co., LTD, Jiangsu (CN)

(72) Inventor: Weihua Qiu, Jiangsu (CN)

(73) Assignee: Changzhou Patent Electronic Technology Co., LTD, Jiangsu (CN)

( * ) Notice: Subject to any disclaimer, the term of this patent is extended or adjusted under 35 U.S.C. 154(b) by 606 days.

(21) Appl. No.: 16/512,182

(22) Filed: Jul. 15, 2019

(65) Prior Publication Data

US 2019/0335813 A1 Nov. 7, 2019

Related U.S. Application Data

(63) Continuation-in-part of application No. PCT/CN2017/118510, filed on Dec. 26, 2017.

(30) Foreign Application Priority Data

Jan. 16, 2017 (CN) ..... 201720048702.6

(51) Int. Cl.

| | |
|---|---|
| ***A24F 13/00*** | (2006.01) |
| ***A24F 40/40*** | (2020.01) |
| ***A24F 7/00*** | (2006.01) |
| ***H05B 3/46*** | (2006.01) |
| ***A24F 40/485*** | (2020.01) |
| *A24F 40/10* | (2020.01) |

(52) U.S. Cl.

CPC ..... *A24F 40/40* (2020.01); *A24F 7/00* (2013.01); *A24F 40/485* (2020.01); *H05B 3/46* (2013.01); *A24F 40/10* (2020.01); *H05B 2203/021* (2013.01)

(58) Field of Classification Search

CPC ..... A24F 47/00
USPC ..... 131/328–329
See application file for complete search history.

(56) References Cited

U.S. PATENT DOCUMENTS

2020/0367556 A1* 11/2020 Lin ..... A24F 40/46

FOREIGN PATENT DOCUMENTS

| | | |
|---|---|---|
| CN | 203575654 U | 5/2014 |
| CN | 104939326 A | 9/2015 |
| CN | 106037020 A | 10/2016 |
| CN | 205831086 U | 12/2016 |

(Continued)

*Primary Examiner* — Phuong K Dinh
(74) *Attorney, Agent, or Firm* — Novick, Kim & Lee, PLLC; Allen Xue

(57) ABSTRACT

The utility model provided an atomizer. The atomizer includes an atomizing head defining an atomizing chamber; and a base seat assembly positioned on an end of the atomizing head. The base seat includes a base seat defining a liquid storage groove in communication with the atomizing chamber. The liquid storage groove is provided with a convex body defining at least one ventilation hole, when the tobacco liquid explodes, the tobacco liquid splashes to the convex body and capable of flowing into the liquid storage groove along the convex body. In the atomizer of the utility model, the tobacco liquid is prevented from leaking through the ventilation hole. It has a simple structure and a notable effect, and lightens the clear-up workload of the user, thereby improving user's experience. The utility model further provides an electronic cigarette having aforementioned atomizer.

19 Claims, 6 Drawing Sheets

(56) References Cited

FOREIGN PATENT DOCUMENTS

| | | | |
|---|---|---|---|
| WO | 2013089551 | A1 | 6/2013 |
| WO | 2015071703 | A1 | 5/2015 |

* cited by examiner

ATOMIZER AND ELECTRONIC CIGARETTE HAVING THE SAME

CROSS-REFERENCE TO RELATED APPLICATIONS

The present application is a continuation-in-part of international application No. PCT/CN2017/118510 filed on Dec. 26, 2017, and claims priority to Chinese patent application No. 201720048702.6 filed on Jan. 16, 2017, and the entire disclosures of the foregoing applications are incorporated herein by reference.

FIELD OF TECHNOLOGY

The utility model relates to a technical field of smoke simulation, and more particularly, relates to an atomizer and an electronic cigarette having the atomizer.

BACKGROUND

In the atomizer structure of conventional electronic cigarette, the tobacco liquid is transferred to the heating member by the liquid guiding member, under the heating by the heating member, the tobacco liquid is atomized to form aerosol, when user inhales, external air flows into the atomizer via the air intake hole, and carries the aerosol into user's mouth. However, in the actual implementation, the tobacco liquid often explodes due to insufficient atomization of the tobacco liquid, i.e. the tobacco liquid splashes in the form of tiny liquid droplet everywhere, some droplets may be adhered on the base seat having a ventilation hole. After a long time in use, the tiny liquid droplets may aggregate to form a relative larger liquid particle, and leak from the atomizer via the ventilation hole, not only a pollution is caused, but also a clear-up workload is increased, and the user's experience is poor.

SUMMARY

Accordingly, it is necessary to provide a leak-proof atomizer and an electronic cigarette having the atomizer.

The technical solution adopted by the utility model to solve the problem is that: an atomizer includes an atomizing head defining an atomizing chamber; and a base seat assembly positioned on an end of the atomizing head. The base seat includes a base seat defining a liquid storage groove in communication with the atomizing chamber; wherein the liquid storage groove is provided with a convex body defining at least one ventilation hole, when the tobacco liquid explodes, the tobacco liquid splashes to the convex body and capable of flowing into the liquid storage groove along the convex body.

Further, at least part of the convex body is configured to form a convex curved surface, the ventilation hole is defined on the convex curved surface.

Further, the atomizing head includes an atomizing sleeve and an atomizing end cover positioned on an end of the atomizing sleeve, the atomizing chamber is constituted by a cavity formed in the atomizing sleeve and the atomizing end cover, an end of the atomizing sleeve away from the atomizing end cover is received in the liquid storage groove, and an external circumferential surface of the atomizing sleeve tightly contacts a sidewall of the liquid storage groove.

Further, the base seat assembly further includes a sealing member, the base seat defines a fixing groove, the sealing member is provided with a fixing post matching the fixing groove, the sealing member is fixedly connected to the base seat via an engagement between the fixing groove and the fixing post.

Further, the atomizer further includes a liquid storage assembly and a mouth piece assembly, wherein the liquid storage assembly includes a liquid storage tube, the mouth piece assembly includes a mouth piece, the base seat is fixedly positioned on an end of the liquid storage tube, the mouth piece is fixedly positioned an opposite end of the liquid storage tube, an interior chamber of the liquid storage tube forms a liquid storage chamber, the atomizing head is fixedly received in the liquid storage chamber.

Further, the atomizing head includes a liquid guiding member and a heating member which are wrapped around each other, the liquid storage chamber and the atomizing chamber are in communication with each other via the liquid guiding member.

Further, a part of the liquid guiding member is positioned within the liquid storage groove.

Further, the liquid storage assembly further includes a ventilation tube received in the liquid storage chamber, an end of the ventilation tube is connected to the liquid storage tube, an opposite end of the ventilation tube is connected to the atomizing head, an interior chamber of the ventilation tube forms an exhaust passage, the mouth piece defines an air exhaust hole, the exhaust passage are in communication with the atomizing chamber and the air exhaust hole, respectively.

Further, a liquid absorbing member is fixedly positioned in the air exhaust hole of the mouth piece.

Another atomizer, includes an atomizing head defining an atomizing chamber and including a liquid guiding member positioned within the atomizing chamber; and a base seat assembly positioned on an end of the atomizing head. The base seta includes a base seat defining a liquid storage groove in communication with the atomizing chamber; wherein the atomizer is placed at a horizontal position or at an inverse position, the tobacco liquid in the liquid storage groove flows into the atomizing chamber and is absorbed by the liquid guiding member Further, the liquid storage groove is provided with a convex body protruded from a bottom of the liquid storage groove, the convex body defines a ventilation hole in communication with the atomizing chamber.

Further, at least part of the convex body is configured to form a convex curved surface, the ventilation hole is defined on the convex curved surface.

Further, the atomizing head further includes a heating member positioned in the atomizing chamber, the base seat assembly further includes an electrode electrically connected to the heating member, the convex body defines an electrode mounting hole, the electrode is assembled within the electrode mounting hole.

Further, the atomizing head further includes an atomizing sleeve and an atomizing end cover positioned on an end of the atomizing sleeve, the atomizing chamber is constituted by a cavity formed in the atomizing sleeve and the atomizing end cover, an end of the atomizing sleeve away from the atomizing end cover is received in the liquid storage groove, and an external circumferential surface of the atomizing sleeve tightly contacts a sidewall of the liquid storage groove.

Further, the atomizer further includes a liquid storage assembly, wherein the liquid storage assembly includes a liquid storage tube, an interior chamber of the liquid storage tube forms a liquid storage chamber, the atomizing head is received in the liquid storage chamber, the base seat is positioned on an end of the liquid storage tube.

Further, the base seat assembly further includes a sealing member, the sealing member is positioned on the base seat, and an external circumferential surface of the sealing member contacts an internal circumferential surface of the liquid storage tube.

Further, the atomizer further includes a mouth piece assembly, wherein the mouth piece assembly includes a mouth piece positioned on an end of the liquid storage tube away from the base seat, the mouth piece defines an air exhaust hole, the liquid storage assembly further includes a ventilation tube received in the liquid storage chamber, an interior chamber of the ventilation tube forms an exhaust passage, the exhaust passage are in communication with the atomizing chamber and the air exhaust hole, respectively.

Further, a liquid absorbing member is positioned in the air exhaust hole.

An electronic cigarette, includes any one of aforementioned atomizer.

The advantages of the utility model are described as follows: in the atomizer of the utility model, when the tobacco liquid explodes, the tobacco liquid splashed everywhere are adhered to the base seat, the tobacco liquid is capable of flowing into the liquid storage groove along the convex body, the tobacco liquid is prevented from leaking through the ventilation hole. It has a simple structure and a notable effect, and lightens the clear-up workload of the user, thereby improving user's experience.

BRIEF DESCRIPTION OF THE DRAWINGS

Exemplary embodiments of the utility model are described more fully hereinafter with reference to the accompanying drawings.

Figure 1:
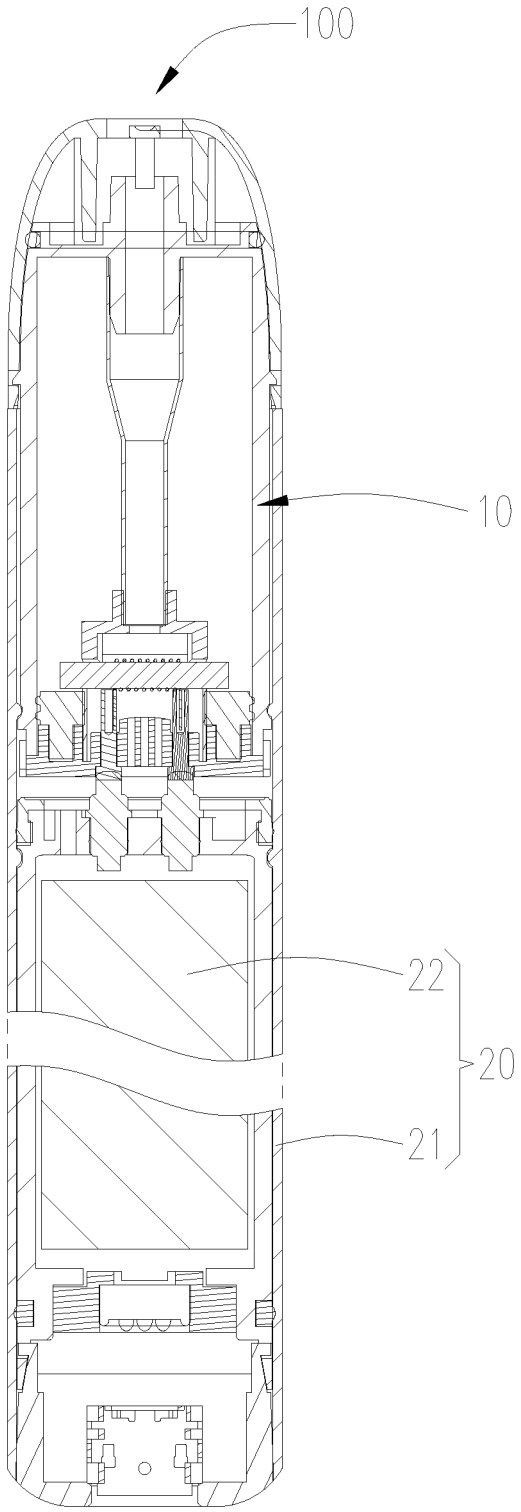
FIG. 1 is a cross-sectional view of an electronic cigarette of a first embodiment of the utility model.

Designations and reference numerals of the part and component in the accompanying drawings

DETAILED DESCRIPTION OF THE PREFERRED EMBODIMENT

The utility model is specifically illustrated with reference to accompanying drawings. The accompanying drawings are schematic views which simplified shows fundamental structures of an exemplary embodiment of the utility model. Thus, merely the constructions related to the utility model are shown.

The First Embodiment

Figure 2:
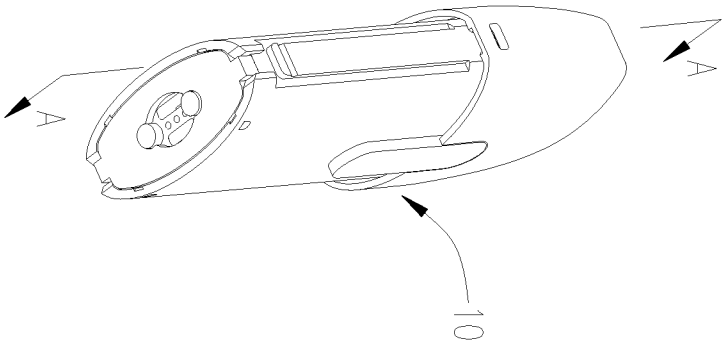
FIG. 2 is a schematic view of an atomizer of the electronic cigarette of FIG. 1.
Figure 3:
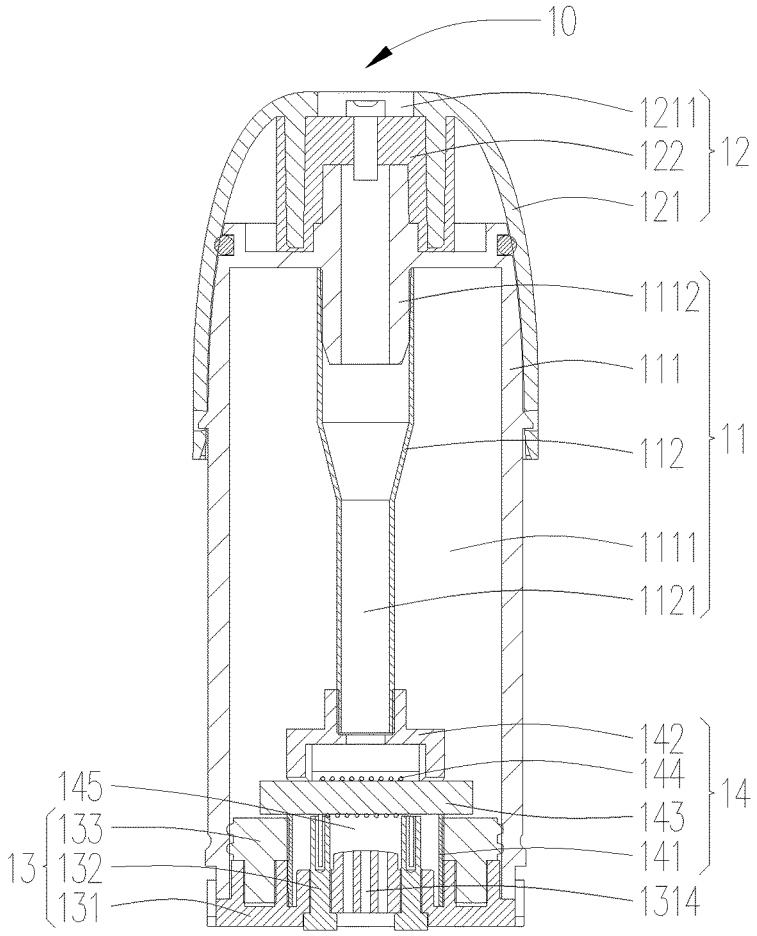
FIG. 3 is a cross-sectional view of the atomizer of FIG. 2, taken along line A-A.

Referring to FIG. 1, an electronic cigarette 100 is provided by the first embodiment of the utility model. The electronic cigarette 100 includes an atomizer 10 and a battery pack 20 electrically connected to the atomizer 10. Referring to FIG. 2 and FIG. 3, wherein the atomizer 10 includes a liquid storage assembly 11, a mouth piece assembly 12 positioned on an end of the liquid storage assembly 11, a base seat assembly 13 positioned on an opposite end of the liquid storage assembly 11, and an atomizing head 14 received in the liquid storage assembly 11.

Referring to FIG. 3, the liquid storage assembly 11 includes a liquid storage tube 111 and a ventilation tube 112 fixedly positioned within the liquid storage tube 111.

The liquid storage tube 111 substantially has a hollow cylindrical structure with an opening at a lower end. The interior chamber of the liquid storage tube 111 forms a liquid storage chamber 1111 for storing the tobacco liquid. The liquid storage tube 111 is provided with a communication tube 1112 at a center of an upper end of the liquid storage tube 111. The communication tube 1112 is in communication with the liquid storage chamber 1111.

The ventilation tube 112 substantially has a hollow cylindrical structure with two openings at opposite ends. The interior space of the ventilation tube 112 forms an exhaust passage 1121. The upper end of the ventilation tube 112 is fixedly sleeved on the communication tube 1112, for establishing a connection between the ventilation tube 112 and the liquid storage tube 111.

It can be understood that, in alternative embodiment not shown, the ventilation tube 112 and the communication tube 1112 are provided with threads, respectively. The ventilation tube 112 is threadedly connected to the liquid storage tube 111 via an engagement between the threads, or, the ventilation tube 112 is provided with a latching tab, the communication tube 1112 defines a latching groove, the ventilation tube 112 is connected to the liquid storage tube 111 via an engagement between the latching tab and the latching groove.

Referring to FIG. 3, the mouth piece assembly 12 includes a mouth piece 121 mounted on an upper end of the liquid storage tube 111 and a liquid absorbing member 122 fixedly positioned within the mouth piece 121.

| | | |
|---|---|---|
| electronic 100 | atomizer 10 | battery pack 20 |
| liquid storage assembly 11 | mouth piece assembly 12 | base seat assembly 13 |
| atomizer 14 | battery pole 21 | battery 22 |
| liquid storage tube 111 | ventilation tube 112 | mouth piece 121 |
| liquid absorbing member 122 | base seat 131 | electrode 132 |
| sealing member 133 | atomizing sleeve 141 | atomizing end cover 142 |
| liquid guiding member 143 | heating member 144 | atomizing chamber 145 |
| liquid storage chamber 1111 | communication tube 1112 | exhaust passage 1121 |
| air exhaust hole 1211 | liquid storage groove 1311 | convex body 1312 |
| convex curved surface 1313 | ventilation hole 1314 | electrode mounting hole 1315 |
| fixing groove 1316 | positioning protrusion 1317 | fixing post 1331 |
| fixing hole 1332 | mounting groove 1411 | connecting tube 1421 |

The mouth piece 121 substantially has a hollow cylindrical structure with an opening at a lower end. The mouth piece 121 defines an air exhaust hole 1211 corresponding to the communication tube 1112. The air exhaust hole 1211 is in communication with the exhaust passage 1121. The liquid absorbing member 122 is fixedly mounted within the air exhaust hole 1211, for preventing the tiny particles of the tobacco liquid from passing through the air exhaust hole 1211 and entering user's mouth, when the tobacco liquid exploded.

When in use, user can swallow the aerosol by directly aligning the mouth to the air exhaust hole 1211. It can be understood that, a connecting member may be assembled to the air exhaust hole 1211, user can swallow the aerosol by holding the connecting member in mouth.

In the illustrated embodiment, the liquid absorbing member 122 is a piece of cotton. It can be understood that, in alternative embodiment not shown, the liquid absorbing member 122 can further be one of fiber rope or non-woven fabric.

In the illustrated embodiment, the mouth piece 121 defines a latching groove (not shown), the liquid storage tube 111 is provided with a latching tab (not shown) corresponding to the latching groove, the mouth piece 121 is latched to the liquid storage tube 111 via an engagement between the latching tab and the latching groove. It can be understood that, in alternative embodiment not shown, the mouth piece 121 can be fixedly connected to the liquid storage tube 111 by plug or threads.

In order to improve an air-tightness between the mouth piece 121 and the liquid storage tube 111, sealing members (not labeled) such as sealing ring or silica gel ring are further provided between the mouth piece 121 and the liquid storage tube 111.

Referring to FIG. 3, the base seat assembly 13 includes a base seat 131 mounted on the lower end of the liquid storage tube 111, an electrode 132 and a sealing member 133 that are mounted on the base seat 131.

Figure 4:
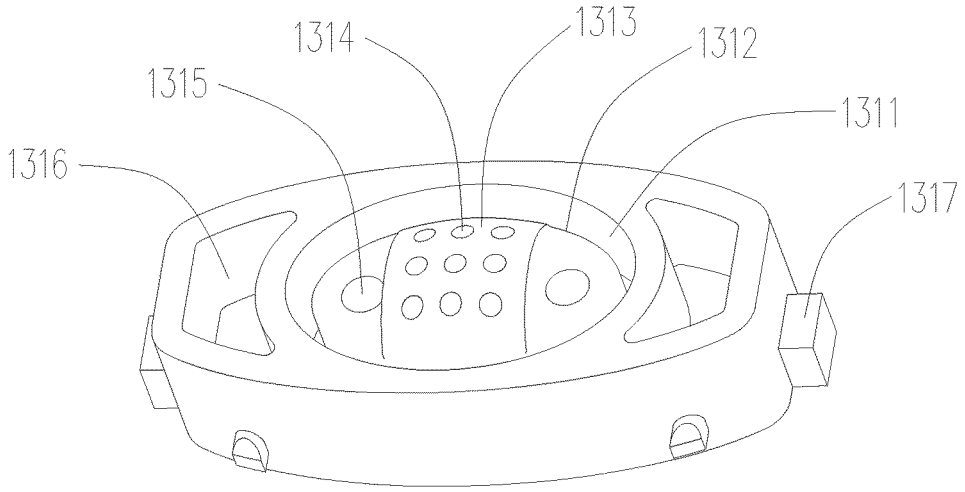
FIG. 4 is a schematic view of a base seat of the atomizer of FIG. 2.
Figure 5:
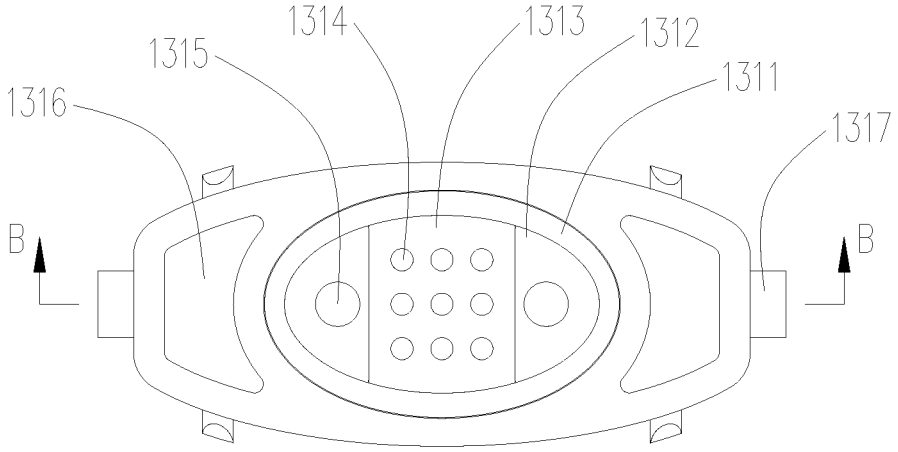
FIG. 5 is a top view of the base seat of FIG. 4.
Figure 6:
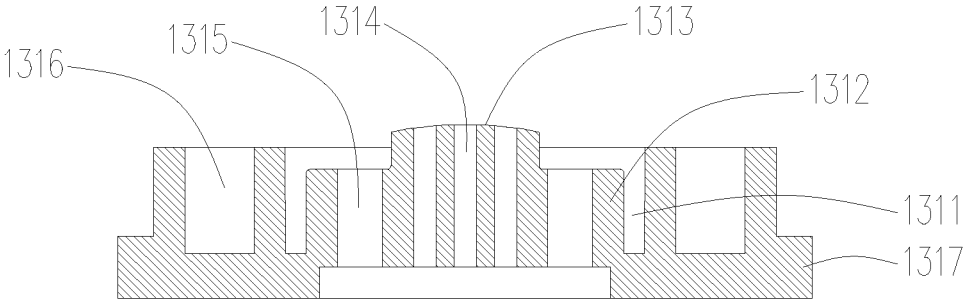
FIG. 6 is a cross-sectional view of the base seat of FIG. 5, taken along line B-B.

Also referring to FIG. 4 through FIG. 6, the base seat 131 substantially has a columnar structure. The base seat 131 defines a liquid storage groove 1311 recessed from a center of an upper end surface of the base seat 131. In the illustrated embodiment, the liquid storage groove 1311 has an elliptical shape. The liquid storage groove 1311 is provided with one convex body 1312 protruded from a bottom of the liquid storage groove 1311, the convex body 1312 defines a plurality of ventilation holes 1314 on an upper end surface of the convex body 1312. The plurality of ventilation holes 1314 extends through the base seat 131. A number of the electrodes 132 is two. Accordingly, the convex body 1312 defines two electrode mounting holes 1315 that are opposite to each other. One electrode 132 is fixedly mounted in one electrode mounting hole 1315, the other one electrode 132 is fixedly mounted in the other one electrode mounting hole 1315. The lower end of the electrode 132 is electrically connected to the battery pack 20. When in use, when the tobacco liquid explodes, the tobacco liquid splashes and flows into the liquid storage groove 1311 along the convex body 1312. Therefore, the tobacco liquid cannot be accumulated on the convex body 1312, such that the electrode 132 mounted on the convex body 1312 by the electrode mounting hole 1315 will not be soaked in the tobacco liquid. A corrosion damage of the electrode 132 soaked in the tobacco liquid can be avoided. It can be understood that, the ventilation holes 1314 can be only one.

At least part of the upper end surface of the convex body 1312 is configured to form a convex curved surface 1313, the ventilation hole 1314 is defined on the convex curved surface 1313, the convex curved surface 1313 can provide a guiding function, facilitating for the tobacco liquid to flow into the liquid storage groove 1311. In the illustrated embodiment, the convex curved surface 1313 is a convex arced surface.

In the illustrated embodiment, the base seat 131 is connected to the liquid storage tube 111 by an interference fit, the external circumferential surface of the base seat 131 contacts the internal circumferential surface of the liquid storage tube 111. The base seat 131 forms two positioning protrusions 1317 extending outwardly from the external circumferential surface of the base seat 131, the two positioning protrusions 1317 are opposed to each other. The liquid storage tube 111 defines a pair positioning grooves (not labeled) corresponding to the positioning protrusions 1317. When assembly, by virtue of an engagement between the positioning protrusions 1317 and the positioning grooves, it facilitates for the connection between the base seat 131 and the liquid storage tube 111. It can be understood that, in alternative embodiment not shown, the base seat 131 can be connected to the liquid storage tube 111 by threads or latching.

The base seat 131 defines two fixing grooves 1316 on an upper end surface of the base seat 131. The two fixing grooves 1316 are positioned on opposite sides of the liquid storage groove 1311.

Figure 7:
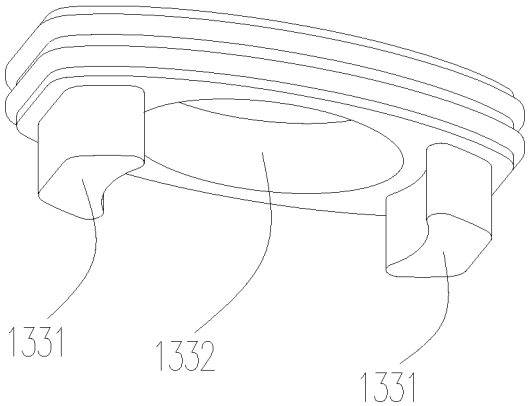
FIG. 7 is schematic view of a sealing member of the atomizer of FIG. 2.

Referring to FIG. 7, the sealing member 133 substantially has an annular structure, the sealing member 133 is provided with two fixing posts 1331 at a lower end surface of the sealing member 133, the two fixing posts 1331 are protruded from the lower end surface and are corresponding to the two fixing grooves 1316. The sealing member 133 is fixedly connected to the base seat 131 by an engagement between the fixing posts 1331 and the fixing grooves 1316. The sealing member 133 defines a fixing hole having an elliptical shape at a center position. When the sealing member 133 is mounted in place, the external circumferential surface of the sealing member 133 tightly contacts the internal circumferential surface of the liquid storage tube 111, thereby a leakage of the tobacco liquid in the liquid storage chamber 1111 out of the connecting potion between the liquid storage tube 111 and the base seat 131 can be avoided.

In the illustrated embodiment, the sealing member 133 can be silica gel ring. It can be understood that, in alternative embodiment not shown, the sealing member 133 can be made of rubber, for providing a sealing function.

Figure 8:
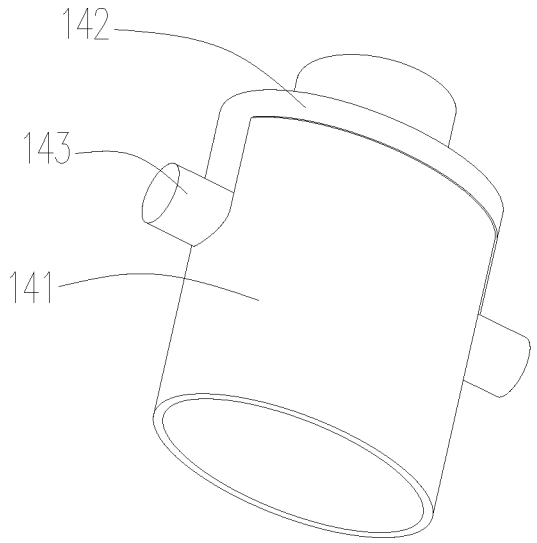
FIG. 8 is schematic view of an atomizing head of the atomizer of FIG. 2.
Figure 9:
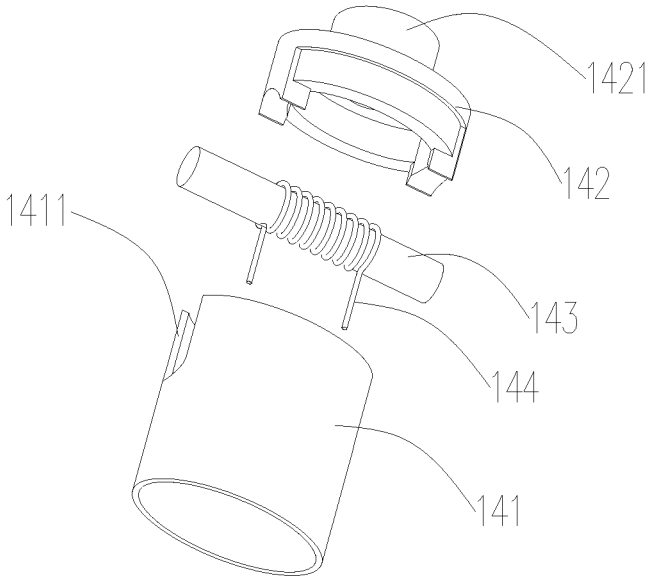
FIG. 9 is an exploded view of the atomizer of FIG. 8.

Also referring to FIG. 3, FIG. 8, and FIG. 9, the atomizing head 14 includes an atomizing sleeve 141, an atomizing end cover 142 positioned on an upper end of the atomizing sleeve 141, a liquid guiding member 143 and a heating member 144. The liquid guiding member 143 and the heating member 144 are positioned on the atomizing sleeve 141.

The atomizing sleeve 141 substantially has a hollow cylindrical structure with two openings at opposite ends. The outer shape of the atomizing sleeve 141 matches with the fixing hole 1332. The atomizing sleeve 141 fixedly extends through the fixing hole 1332, and the lower end of the atomizing sleeve 141 is received within the liquid storage groove 1311. The external circumferential surface of the atomizing sleeve 141 tightly contacts the sidewall of the liquid storage groove 1311. Because the sealing member 133 is tightly sleeved on the atomizing sleeve 141, the sealing member 133 can provide a fixation function for the atomizing sleeve 141, preventing misalignment of the atomizing sleeve 141, thus the tobacco liquid in the liquid storage groove 1311 cannot flow out of the liquid storage groove 1311.

Referring to FIG. 8 and FIG. 9, the sidewall of the atomizing sleeve 141 defines two mounting grooves 1411 opposite to each other. The mounting groove 1411 has an U shaped structure and is in communication with the upper end of the atomizing sleeve 141. Opposite ends of the liquid guiding member 143 are supported by the mounting groove 1411, respectively, the liquid guiding member 143 is configured to absorb the tobacco liquid. The heating member 144 is wrapped around the liquid guiding member 143, opposite ends of the heating member 144 are electrically connected to the corresponding electrodes 132, respectively. In illustrated embodiment, the liquid guiding member 143 is a piece of cotton, the heating member 144 is a heating strip. It can be understood that, the liquid guiding member 143 can further be a combination of two or more than two materials selected from a porous ceramic, a fiber rope, a foam metal, and a foam graphite. The liquid guiding member 143 can further be wrapped around the heating member 144.

The atomizing end cover 142 substantially has an annular structure, the lower end of the atomizing end cover 142 is fixedly connected to the atomizing sleeve 141 by an interference fit. Referring to FIG. 3, a cavity formed in the atomizing sleeve 141 and the atomizing end cover 142 constitutes an atomizing chamber 145 in communication with the liquid storage groove 1311. Also referring to FIG. 9, the upper end of the atomizing end cover 142 extends upward to form a connecting tube 1421 in communication with the atomizing chamber 145. The connecting tube 1421 is fixedly sleeved on the lower end of the ventilation tube 112, allowing the exhaust passage 1121 to be in communication with the atomizing chamber 145.

Referring to FIG. 1, the battery pack 20 includes a battery pole 21 connected to the liquid storage tube 111 and a battery 22 fixedly assembled in the battery pole 21. In the illustrated embodiment, the inner sidewall of the battery pole 21 is provided with a latching tab (not labeled), the outer sidewall of the liquid storage tube 111 defines a latching groove (not labeled) engaging the latching tab (not labeled). The battery pole 21 is fixedly latched to the liquid storage tube 111 by an engagement between the latching tab and the latching groove. The battery 22 is electrically connected to the electrode 132, for provide electric drive for the heating member 144. The tobacco liquid absorbed by the liquid guiding member 143 is heated and atomized by the heating member 144 to form aerosol, the aerosol fills the atomizing chamber 145.

In order to facilitate for the air to flow into the atomizer 10, the sidewall of the battery pole 21 defines an air intake hole (not shown) in communication with the ventilation hole 1314.

The use procedure of the atomizer 10 of the utility model is illustrated with reference to the companying drawings.

Referring to FIG. 3, when user inhales, external air flows through the air intake hole and the ventilation hole 1314, and enters the atomizing chamber 145 to mix with the aerosol, the mixed aerosol flows through the exhaust passage 1121 and the air exhaust hole 1211 successively, and enters into user's mouth.

When the tobacco liquid explodes due to insufficient atomization, the tobacco liquid splashes in the form of tiny liquid droplets everywhere. Referring to FIG. 4 through FIG. 6, when the tobacco liquid splashes to the convex body 1312 of the base seat 131, under the guidance of the convex curved surface 1313, the tobacco liquid flows into the liquid storage groove 1311, the tobacco liquid is effectively prevented from flowing out of the atomizer 10 via the ventilation hole 1314. When the tobacco liquid splashes to the internal wall of the atomizing sleeve 141 and the internal wall of the atomizing end cover 142, the tobacco liquid flows into the liquid storage groove 1311 along the internal wall of the atomizing sleeve 141. Referring to FIG. 3, when the tobacco liquid splashes toward the mouth piece 121, it is finally blocked and absorbed by the liquid absorbing member 122 positioned within the air exhaust hole 1211.

It can be understood that, in addition to gather the splashed tiny droplets of the tobacco liquid when the tobacco liquid explodes, because the liquid storage groove 1311 is in communication with the atomizing chamber 145, after entering the atomizing chamber 145, all the tobacco liquid which cannot flow out via the exhaust passage 1121 and the air exhaust hole 1211 in the form of aerosol can be gathered in the liquid storage groove 1311. For example, after use, the aerosol which cannot flow out is condensed to form tiny liquid droplets, such tiny liquid droplets can be gathered by the liquid storage groove 1311. For another example, after the tobacco liquid in the liquid storage chamber 1111 is leaked into the atomizing chamber 145, the leaked tobacco liquid can also be gathered by the liquid storage groove 1311.

At the same time, because the air flow is inhaled via the ventilation hole 1314, driven by the air flow, the tobacco liquid splashed on the convex body 1312 will fly upward again, and flows into the liquid storage groove 1311 along the convex body 1312.

After use, user places the atomizer 10 at a horizontal position or at an inverse position, the tobacco liquid in the liquid storage groove 1311 will flow to the liquid guiding member 143 along the atomizing sleeve 141, and is thus absorbed by the liquid guiding member 143, for the next atomization and use. Therefore, the tobacco liquid in the liquid storage groove 1311 is fully used, a leakage of redundant tobacco liquid in the liquid storage groove 1311 via the ventilation hole 1314 can be avoided.

In the atomizer 10 of the utility model, when the tobacco liquid explodes, the tobacco liquid splashed everywhere, adhering to the base seat 131, under the guidance of the convex curved surface 1313 of the convex body 1312, the tobacco liquid flows into the liquid storage groove 1311, the tobacco liquid is prevented from leaking through the ventilation hole 1314 of the convex body 1312. It has a simple structure and a notable effect, and lightens the clear-up workload of the user, improving user's experience.

In the electronic cigarette 100 provided by the utility model, because the electronic cigarette 100 includes all technical features of aforementioned atomizer 10, thus the electronic cigarette 100 processes technical effect same as that of aforementioned atomizer 10.

The Second Embodiment

Figure 10:
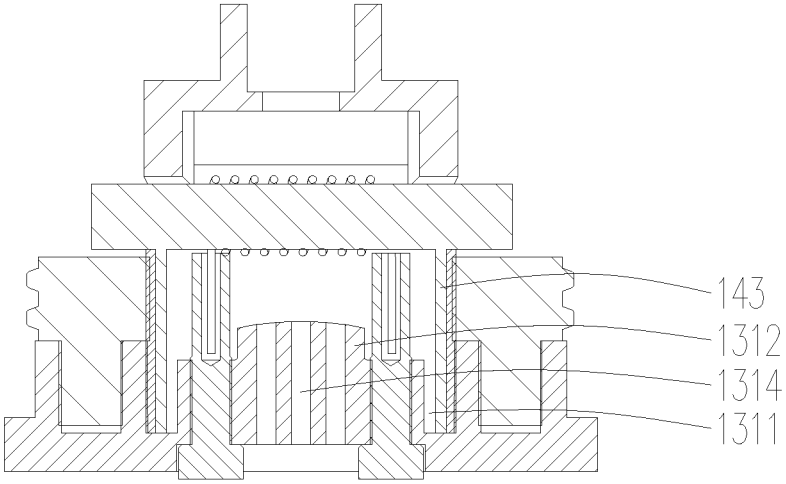
FIG. 10 is a cross-sectional view of the electronic cigarette of a second embodiment of the utility model when the atomizer is connected to the base seat assembly.

Referring to FIG. 10, the difference between the electronic cigarette 100 provided by the second embodiment and the electronic cigarette 100 provided by the first embodiment is that, a part of the liquid guiding member 143 extends downward into the liquid storage groove 1311. In this situation, the tobacco liquid flowing into the liquid storage groove 1311 along the convex body 1312 can be absorbed and utilized by the liquid guiding member 143 timely, preventing the redundant tobacco liquid in the liquid storage groove 1311 from submerging the convex body 1312, and a leakage of the tobacco liquid via the ventilation hole 1314 is avoided. Compared to the electronic cigarette 100 of the first embodiment, the tobacco liquid in the liquid storage groove 1311 can also be absorbed and utilized by the liquid guiding member 143 without placing the electronic cigarette 100 at a horizontal position or at an inverse position, a leakage of the redundant tobacco liquid in the liquid storage groove 1311 can further be avoided.

The embodiments described above are merely preferred embodiments, but not intended to limit the application. Any modifications, alternatives or improvements made within the principle and spirit of the present application should be interpreted as falling within the protection scope of the present application. The claims are not limited to the features or acts described above. Rather, the proper scope of the disclosure is defined by the appended claims.

What is claimed is:

1. An atomizer, comprising:

an atomizing head defining an atomizing chamber; and a base seat assembly positioned on an end of the atomizing head, and comprising a base seat defining a liquid storage groove in communication with the atomizing chamber;

wherein the liquid storage groove is provided with a convex body defining at least one ventilation hole, and, when the tobacco liquid explodes, the tobacco liquid splashes to the convex body and is capable of flowing into the liquid storage groove along the convex body.

2. The atomizer according to claim 1, wherein at least a part of the convex body is configured to form a convex curved surface, and the ventilation hole is defined on the convex curved surface.

3. The atomizer according to claim 1, wherein the atomizing head comprises an atomizing sleeve and an atomizing end cover positioned on an end of the atomizing sleeve, the atomizing chamber is constituted by a cavity formed in the atomizing sleeve, an end of the atomizing sleeve away from the atomizing end cover is received in the liquid storage groove, and an external circumferential surface of the atomizing sleeve contacts a sidewall of the liquid storage groove.

4. The atomizer according to claim 1, wherein the base seat assembly further comprises a sealing member, the base seat defines a fixing groove, the sealing member is provided with a fixing post matching the fixing groove, the sealing member is fixedly connected to the base seat via an engagement between the fixing groove and the fixing post.

5. The atomizer according to claim 1, further comprising a liquid storage assembly and a mouth piece assembly, wherein the liquid storage assembly comprises a liquid storage tube, the mouth piece assembly comprises a mouth piece, the base seat is fixedly positioned on a first end of the liquid storage tube, the mouth piece is fixedly positioned on a second end of the liquid storage tube, an interior chamber of the liquid storage tube forms a liquid storage chamber, the atomizing head is fixedly received in the liquid storage chamber.

6. The atomizer according to claim 5, wherein the atomizing head comprises a liquid guiding member and a heating member that are wrapped around each other, the liquid storage chamber and the atomizing chamber are in communication with each other via the liquid guiding member.

7. The atomizer according to claim 6, wherein a part of the liquid guiding member is positioned within the liquid storage groove.

8. The atomizer according to claim 5, wherein the liquid storage assembly further comprises a ventilation tube received in the liquid storage chamber, a first end of the ventilation tube is connected to the liquid storage tube, a second end of the ventilation tube is connected to the atomizing head, an interior chamber of the ventilation tube forms an exhaust passage, the mouth piece defines an air exhaust hole, the exhaust passage is in communication with the atomizing chamber and the air exhaust hole.

9. The atomizer according to claim 8, wherein a liquid absorbing member is fixedly positioned in the air exhaust hole of the mouth piece.

10. An electronic cigarette, comprising an atomizer according to claim 1.

11. An atomizer, comprising:

an atomizing head defining an atomizing chamber and comprising a liquid guiding member positioned within the atomizing chamber; and a base seat assembly positioned on an end of the atomizing head, and comprising a base seat defining a liquid storage groove in communication with the atomizing chamber;

wherein the atomizer is placed at a horizontal position or at an inverse position, the tobacco liquid in the liquid storage groove flows into the atomizing chamber and is absorbed by the liquid guiding member, and the liquid storage groove is provided with a convex body protruded from a bottom of the liquid storage groove, the convex body defines a ventilation hole in communication with the atomizing chamber.

12. The atomizer according to claim 11, wherein at least a part of the convex body is configured to form a convex curved surface, the ventilation hole is defined on the convex curved surface.

13. The atomizer according to claim 11, wherein the atomizing head further comprises a heating member positioned in the atomizing chamber, the base seat assembly further comprises an electrode electrically connected to the heating member, the convex body defines an electrode mounting hole, the electrode is assembled within the electrode mounting hole.

14. The atomizer according to claim 11, wherein the atomizing head further comprises an atomizing sleeve and an atomizing end cover positioned on an end of the atomizing sleeve, the atomizing chamber is constituted by a cavity formed in the atomizing sleeve and the atomizing end cover, an end of the atomizing sleeve away from the atomizing end cover is received in the liquid storage groove, and an external circumferential surface of the atomizing sleeve contacts a sidewall of the liquid storage groove.

15. The atomizer according to claim 11, further comprising a liquid storage assembly, wherein the liquid storage assembly comprises a liquid storage tube, an interior chamber of the liquid storage tube forms a liquid storage chamber, the atomizing head is received in the liquid storage chamber, the base seat is positioned on an end of the liquid storage tube.

16. The atomizer according to claim 15, wherein the base seat assembly further comprises a sealing member positioned on the base seat, and an external circumferential surface of the sealing member contacts an internal circumferential surface of the liquid storage tube.

17. The atomizer according to claim 15, further comprising a mouth piece assembly, wherein the mouth piece assembly comprises a mouth piece positioned on an end of the liquid storage tube away from the base seat, the mouth piece defines an air exhaust hole, the liquid storage assembly further comprises a ventilation tube received in the liquid storage chamber, an interior chamber of the ventilation tube forms an exhaust passage is in communication with the atomizing chamber and the air exhaust hole.

18. The atomizer according to claim 17, wherein a liquid absorbing member is positioned in the air exhaust hole.

19. An electronic cigarette, comprising the atomizer according to claim 1.

* * * * *